US005467987A

United States Patent [19]

Perkins et al.

[11] Patent Number: 5,467,987

[45] Date of Patent: Nov. 21, 1995

[54] GOLF PUTTERS

[76] Inventors: James E. Perkins, 1110 Wannamaker Ave.; Michael G. Buffkin, 2813 W. Juniper Rd., both of Florence, S.C. 29501

[21] Appl. No.: 118,219

[22] Filed: Sep. 9, 1993

[51] Int. Cl.[6] ..... A63B 53/04

[52] U.S. Cl. ..... 273/175; 273/167 B; 273/167 J

[58] Field of Search ..... 273/167 R–177 A, 273/193 R, 194 R, 194 A, 162 R, 164.1, 187.4, 186.1, 186.2

[56] References Cited

U.S. PATENT DOCUMENTS

| | | | |
|---|---|---|---|
| D. 240,245 | 6/1976 | Aragoma . | |
| 1,467,714 | 9/1923 | Doerr . | |
| 1,525,137 | 2/1925 | Lawton . | |
| 2,665,909 | 1/1954 | Wilson . | |
| 3,085,804 | 4/1963 | Pieper . | |
| 3,333,854 | 8/1967 | White . | |
| 3,869,126 | 3/1975 | Thompson | 273/167 J X |
| 4,000,902 | 1/1977 | Perkins | 273/164.1 |
| 4,026,561 | 5/1977 | Baldorossi | 273/193 R |
| 4,162,074 | 7/1979 | Thomson | 273/175 |
| 4,165,076 | 8/1979 | Cella . | |
| 4,312,509 | 1/1982 | Grant | 273/167 A |
| 4,461,482 | 7/1984 | Bojicic | 273/175 X |
| 4,664,385 | 5/1987 | Macera . | |
| 4,867,457 | 9/1989 | Lowe | 273/167 B |
| 4,872,684 | 10/1989 | Dippel . | |
| 4,881,739 | 11/1989 | Garcia | 273/167 B X |

FOREIGN PATENT DOCUMENTS 1008972 11/1965 United Kingdom .

*Primary Examiner*—Sebastiano Passaniti

*Attorney, Agent, or Firm*—Wigman, Cohen, Leitner & Myers

[57] ABSTRACT

A golf putter having a club head with a striking face comprising a striking edge defined by at least two substantially planar surfaces which engages a golf ball at a point below the center of the golf ball and imparts a substantially immediate forward roll to the ball resulting in a truer path of travel of the ball and better control of putting distance.

17 Claims, 2 Drawing Sheets

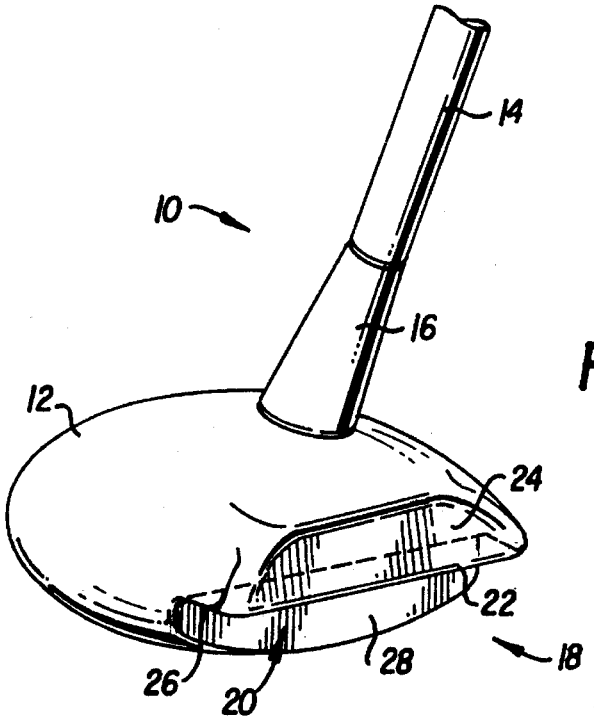
FIG. 1
FIG. 3
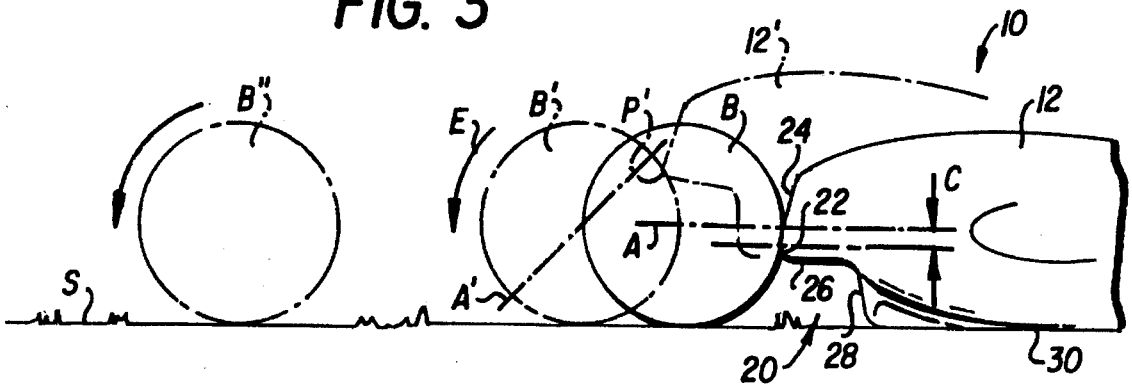
FIG. 2
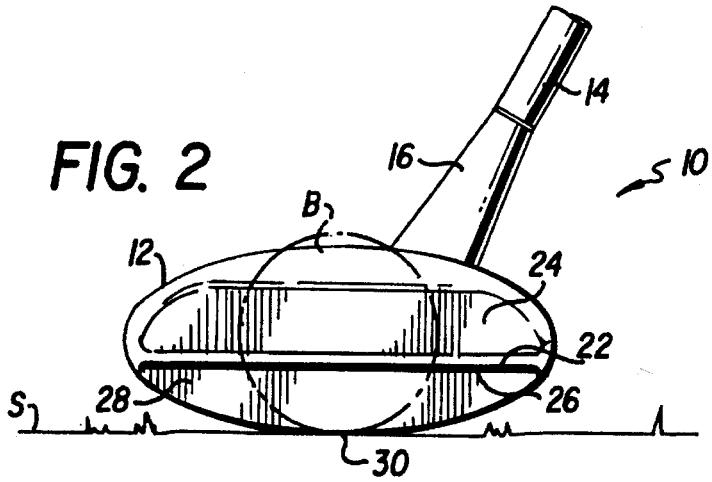

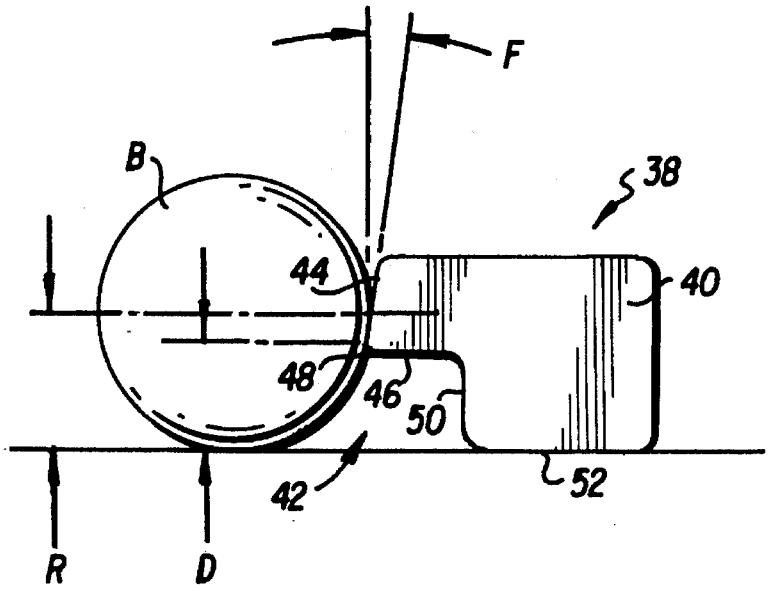
FIG. 4
FIG. 5
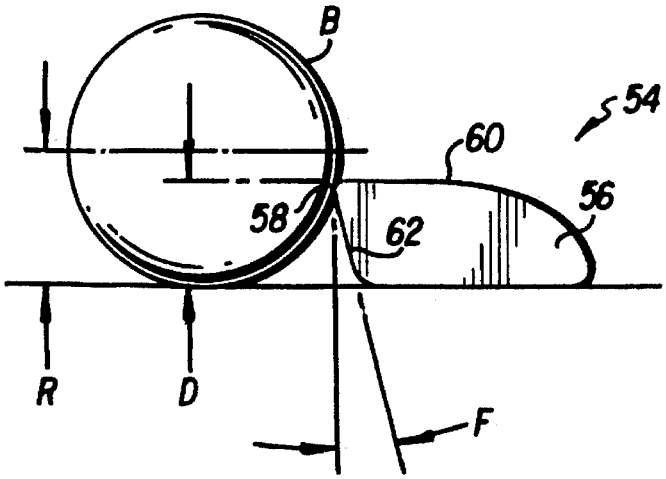
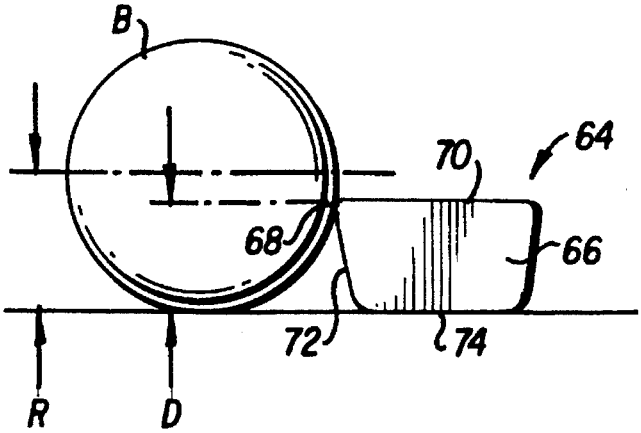
FIG. 6

GOLF PUTTERS

FIELD OF THE INVENTION

The present invention relates to sports and recreation equipment and more particularly to an improved golf putter for imparting forward roll to a golf ball immediately upon impact.

BACKGROUND OF THE INVENTION

The prior art is replete with golf putter designs that are said to improve the roll and path of travel of a golf ball so as to provide greater putting accuracy for the golfer. Typically, a golf putter is provided with a substantially vertical planar face for striking a golf ball along a line substantially through the center of gravity of the ball. In such known putter designs, the ball initially translates or slides across the putting surface without substantial spin or roll until the frictional forces between the ball and the putting surface impart a forward rolling motion to the ball. This phenomenon .and the problems associated with putters having a vertical planar impact surface are described, for example, in U.S. Pat. No. 4,872,684 to Dippel.

According to the Dippel patent, immediate forward spin or roll may be imparted to the golf ball by means of a putter with a cylindrical club head having a diameter slightly smaller than the diameter of the golf ball. In this way according to the patentee, the club will strike the ball slightly below a horizontal plane through the center of gravity of the ball and the cylindrical head remains in rolling contact with the ball so as to impart immediate forward spin to the ball thereby achieving a truer path of the ball. Similar putters with a cylindrical club head are also disclosed in British Patent No. 1,008,972 and U.S. Pat. No. 2,665,909 to Wilson.

A number of prior art patents disclose golf putters in which the club head is provided with a curved or planar surface or an edge positioned to strike a golf ball at a point above a horizontal plane containing the center of gravity of the ball. U.S. Pat. No. 1,467,714 to Doerr; U.S. Pat. No. 1,525,137 to Lawton; U.S. Pat. No. 3,085,804 to Pieper; U.S. Pat. No. 3,333,854 to White; U.S. Pat. No. 4,165,076 to Cella; and U.S. Pat. No. 4,664,385 to Macera are all representative of patents disclosing putters intended to impart topspin by striking the ball above a horizontal plane containing the center of gravity of the ball.

While some or all of the aforementioned prior art golf putters may be operative to impart a degree of forward roll to a golf ball when the ball is struck in the manner described by the patentees, it is believed that a consistent forward roll using the prior art putters cannot be readily achieved by golfers of all levels from the professional to the occasional or beginning golfer. It would be desirable, therefore, to provide a golf putter that may be used by professional, amateur and beginning golfers alike to consistently impart an immediate or substantially instantaneous forward roll to a golf ball when the ball is struck by the putter club head.

SUMMARY AND OBJECTS OF THE INVENTION

It is therefore a primary object of the present invention to provide an improved golf putter that will impart immediate or substantially instantaneous forward roll to a golf ball. This object is achieved by a club head designed to engage a golf ball along a horizontal striking edge positioned below a horizontal plane containing the center or center of gravity of the ball.

It is another object of the invention to provide an improved golf putter that can be used by professionals and amateurs alike to improve their golf game, specifically their putting.

Another object of the invention is to provide a golf putter that can be provided with a club head of varying mass and shape so long as it incorporates a horizontal striking edge positioned below a horizontal plane through the center or center of gravity of the ball.

Still another object of the invention is to provide a club head for a putter that incorporates a striking edge having a height above the bottom surface of the club head equal to about one-third (⅓) of the diameter of the golf ball.

The foregoing objects of the invention are accomplished according to a preferred embodiment of the invention by a club head having an undercut striking face which has a rearwardly inclined planar portion terminating along a horizontal lower striking edge disposed at a height above the bottom surface of the club head less than one-half the diameter of a golf ball. The club head may have any suitable mass and shape so long as the horizontal striking edge is positioned so as to engage the golf ball at a point below the center or center of gravity of the ball.

In alternate embodiments of the invention the horizontal striking edge is positioned along an upper edge of the club head such that the height of the club head is equal to or less than one-half the diameter of a golf ball. It should be understood that the golf putter of the present invention may be designed for use with a 1,625 inch diameter English golf ball, a U.S. standard 1,680 inch diameter golf ball, the newer 1.720 inch diameter golf ball or any other diameter golf ball.

With the foregoing and other objects, advantages and features of the invention that will become hereinafter apparent, the nature of the invention may be more clearly understood by reference to the following detailed description of the invention, the appended claims, and to the several views illustrated in the drawings.

BRIEF DESCRIPTION OF THE DRAWINGS

FIG. 1 is a perspective view of one preferred embodiment of the golf putter of the invention;

FIG. 2 is a front elevation view of the embodiment of the invention depicted in FIG. 1 shown addressing a golf ball;

FIG. 3 is a fragmentary side elevation view of the golf putter of FIGS. 1 and 2 illustrating the manner in which the club strikes a golf ball and imparts a forward rolling motion to the ball;

FIG. 4 is a side elevation view of a second embodiment of the golf putter of the invention shown addressing a golf ball;

FIG. 5 is a side elevation view of a third embodiment of the golf putter of the invention shown addressing a golf ball; and FIG. 6 is a side elevation view of a fourth embodiment of the golf putter of the invention shown addressing a golf ball.

DETAILED DESCRIPTION OF THE INVENTION

Referring now to the drawings, there is illustrated in FIGS. 1–3 a first embodiment of the golf putter of the invention which is designated generally by reference numeral 10. Putter 10 comprises a club head 12 attached to a shaft 14 by means of a hosel 16 in a generally conventional manner. Shaft 14 may be of any conventional design and forms no part of the present invention.

Club head 12 is provided on its forward, ball-engaging face 18 with an undercut 20 which defines a horizontally extending, ball striking edge 22. More particularly, the ball engaging face 18 of the club head 12 is defined by three substantially planar surfaces comprising from top to bottom a first planar surface 24 extending from the striking edge 22 upwardly and rearwardly, a second planar surface 26 extending rearwardly from the striking edge 22 substantially horizontally, i.e., at an angle of substantially 90° from a vertical axis passing through the striking edge 22, and a third planar surface 28 extending downwardly and rearwardly from the second planar surface. As will be appreciated, the striking edge 22 is formed by the intersection of the first and second planar surfaces 24, 26 which intersection is preferably provided with a small radius, e.g., from about 0.015 to about 0.100 inches, to avoid a sharp cutting edge.

The rearward inclination of the first planar surface 24 may be any angle which is sufficient to avoid contact between the planar surface 24 above edge 22 and a ball lying on a putting surface. An angle of about 5°–15° is preferred however a greater angle may be employed.

As best illustrated in FIGS. 2 and 3 the location of the striking edge 22 relative to a horizontal plane A containing the center of a golf ball B is an important aspect of the present invention. Preferably, the striking edge 22 is located from about 0.450–0.750 inches above the base 30, and most preferably from about 0.550–0.650 inches above the base 30, or the lowermost point of base 30, of the club head 12. Such location will position the striking edge 22 a distance C of about 0.090–0.390 below the horizontal plane A containing the center of a standard ball B having a diameter of 1.680 inches when the club head 12 and the ball B are resting on the plane of putting surface S.

It should be understood that the particular shape and structure of the club head 12 and the forward face 18 of the club head may vary substantially so long as the club head structure provides the substantially straight horizontal striking edge 22 positioned at an appropriate height for striking a golf ball below its center with sufficient relief above and below the striking edge 22 so that no other portion or surface of the club head 12 contacts the ball during the putting stroke.

Referring specifically to FIG. 3, there is illustrated in solid lines the position of the club head 12 and ball B at the time when the striking edge 22 of club head 12 just contacts the ball B at point P. At some brief time interval thereafter it is believed that the positions of the ball and club head are as depicted in phantom lines designating the ball B', the club head 12' and the point of contact therebetween P'. In this way it is believed that the force applied to the ball B by the striking edge 22 between points P and P' causes an immediate or substantially instantaneous forward roll or rotation of the ball B as shown by the direction of arrow E without lift or any horizontal translation or sliding. Shortly after the ball B reaches the position B' it is believed that the ball and club head separate and the ball begins to roll freely as shown in phantom lines at B" in FIG. 3.

Advantageously., the immediate forward roll imparted to the ball results in a truer path of travel of the ball and better control of putting distance. It is believed that the truer path of the ball is the result of striking the ball at a point below the center of the ball with a striking edge designed to minimize rolling contact between the striking edge and the ball. The construction of the striking face of the club head in the manner described above makes it extremely easy for both professional and beginning golfers to properly address the ball with the striking edge with little or no difficulty. While it is believed that the above explanation of the manner of operation of the golf putter of the invention is accurate, it is not intended that the invention be limited by such explanation unless specifically set forth in the claims herein.

Referring now to FIGS. 4–6, three additional embodiments of the golf putter of the invention are shown which illustrate how the invention may be variously embodied in club heads of varying shapes and sizes. For convenience, the club shafts and hosels have not been illustrated.

The second embodiment of the invention shown in FIG. 4 comprises a putter 38 with a club head 40 having a striking face 42 with a structure similar to that of the first embodiment. Striking face 42 comprises a first inclined planar surface 44 which intersects a second horizontal planar surface 46 at a striking edge 48. A third vertical planar surface 50 extends from the surface 46 to the base 52 of the club head 40. The first surface 44 is rearwardly inclined at an angle F so that only edge 48 contacts the ball B when it is struck by the club head 40.

Edge 48 is positioned a distance or height D above the base 52 of the club head 40 so that edge 48 strikes the ball B at the height D less than the radius dimension R of the ball B or below a horizontal plane containing the center of the ball. The angle F and height D are preferably within the ranges specified above for the embodiment of FIGS. 1–3.

FIG. 5 illustrates a third embodiment of the invention in which the putter 54 comprises a club head 56 having a striking edge 58 defined by the intersection between horizontal planar surface 60 extending at substantially 90° from a vertical axis passing through striking edge 58 and forming the top surface of the club head 56 and a second planar surface 62 downwardly and rearwardly inclined at an angle F. Edge 58 is in a plane coincident with top planar surface 60 of the club head 56 at a height D less than the radius R of ball B.

A fourth embodiment of the invention is shown in FIG. 6 wherein a putter 64 comprises a club head 66 with a rounded striking edge 68 disposed at the intersection between a first horizontal planar surface 70 extending at substantially 90° from a vertical axis passing through striking edge and a second downwardly and rearwardly inclined planar surface 72. Striking edge 68 is located at a height D above base 74 less than the radius R of the golf ball B.

It will be appreciated by those skilled in the art that configurations of club heads other than those illustrated in FIGS. 1–6 may incorporate the principles of the present invention. For example, the principles of the invention may be embodied in a club head having a striking face defined by a pair of inclined planes intersecting at a striking edge, such as a combination of plane 44 of club head 40 and plane 62 of club head 56, intersecting at edge 48 (or 58). Other combinations will occur to those skilled in the art in light of the teachings herein.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A golf putter for use with a golf ball having a diameter between about 1.625 to about 1.720 inches comprising a club head having a base and a forward striking face, said striking face comprising a horizontal striking edge defined by at least two substantially planar surfaces rearwardly inclined from a vertical axis passing through said striking edge, said two planar surfaces comprising a first planar surface inclined rearwardly away from said striking edge and a second planar surface extending at substantially 90° from said vertical axis, said striking edge being located at a height of about 0.450–0.750 inch above said base so as to impart a substantially immediate forward roll to a golf ball when such golf ball is struck by said striking edge.

2. The golf putter of claim 1, wherein said second planar surface is located substantially in the plane of said striking edge and the first planar surface is located above said striking edge.

3. The golf putter of claim 1, wherein said second planar surface is located substantially in the plane of the striking edge and the first planar surface is located below said striking edge.

4. The golf putter of claim 3, wherein the second planar surface is the top surface of the club head.

5. The golf putter of claim 1, wherein the inclination of said first planar surface is 5° or more.

6. The golf putter of claim 1, wherein the inclination of said first planar surface is about 5°–15°.

7. The golf putter of claim 1, wherein said striking edge has a radius of from about 0.015 to about 0.100 inches.

8. A golf putter comprising a club head having a base and a forward striking face, said striking face comprising a horizontal striking edge defined by at least two substantially planar surfaces, said striking edge being located at a predetermined height above said base so as to impart a substantially immediate forward roll to a golf ball struck by said striking edge, said two planar surfaces comprising a first planar surface located above and inclined rearwardly away from said striking edge and a second horizontal surface located substantially in the plane of said striking edge, and including a third planar surface extending from the second planar surface to the base of said club head.

9. A golf putter comprising a club head having a forward striking face and a base, said striking face comprising first, second and third planar surfaces, a striking edge defined by the intersection between said first and second planar surfaces, said first planar surface being located above said striking edge and inclined rearwardly from a vertical axis passing through said striking edge, said second planar surface extending horizontally and rearwardly from said striking edge, said third planar surface extending between said second planar surface and said base, said striking edge being located at a predetermined height above said base so as to impart a substantially immediate forward roll to a golf ball struck by said striking edge.

10. The golf putter of claim 9, wherein the height of said striking edge above said base is in the range of 0.450–0.750 inch.

11. The golf putter of claim 9, wherein the inclination of said first planar surface is 5° or more.

12. The golf putter of claim 9, wherein the inclination of said first planar surface is about 5°–15°.

13. The golf putter of claim 9, wherein said striking edge has a radius of from about 0.015 to about 0.100 inch.

14. The golf putter of claim 9, wherein the third planar surface is rearwardly inclined from said second planar surface to said base.

15. A golf putter comprising a club head having a base and a forward striking face, said striking face comprising a striking edge having a radius of from about 0.015 to about 0.100 inch and a height above said base in the range of about 0.450–0.750 inch so as to impart a substantially immediate forward roll to a golf ball when said golf ball is struck by said striking edge, said striking edge being defined by at least two surfaces extending rearwardly from a vertical axis passing through said striking edge, said two surfaces comprising a first planar surface inclined rearwardly from said vertical axis and a second planar surface extending at substantially 90° from said vertical axis.

16. The golf putter of claim 15, wherein said first planar surface is located above said striking edge and said second planar surface is located substantially in the plane of said striking edge.

17. The golf putter of claim 15, wherein said first planar surface is located below said striking edge and said second planar surface is located substantially in the plane of said striking edge.

* * * * *